United States Patent [19]

Neri

[11] Patent Number: 4,688,583

[45] Date of Patent: Aug. 25, 1987

[54] DEVICE FOR VERIFICATION AND CORRECTION OF THE TRANSVERSE DIMENSIONS OF PRODUCTS IN THE FORM OF A ROD, IN PARTICULAR IN MACHINES FOR THE MANUFACTURE OF CIGARETTES AND THE LIKE

[75] Inventor: Armando Neri, Bologna, Italy

[73] Assignee: G. D. Societa per Azioni, Bologna, Italy

[21] Appl. No.: 812,322

[22] Filed: Dec. 23, 1985

[30] Foreign Application Priority Data

Jan. 23, 1985 [IT] Italy ..... 3311 A/85

[51] Int. Cl.[4] ..... A24C 5/34; G01B 7/12

[52] U.S. Cl. ..... 131/84.2; 131/906; 131/84.1

[58] Field of Search ..... 131/84.1, 84.2, 84.3, 131/84.4, 904–906, 908, 64.2, 66.2; 250/560, 214 AG; 356/384–387, 376; 33/143 L, 147 L, 147 N

[56] References Cited

U.S. PATENT DOCUMENTS

| | | | |
|---|---|---|---|
| 3,007,252 | 11/1961 | Munn | 33/178 E |
| 3,854,587 | 12/1974 | McLoughlin et al. | 131/906 |
| 4,033,360 | 7/1977 | Niehow et al. | 131/84.1 |
| 4,189,841 | 2/1980 | Loepfe | 33/143 L |
| 4,198,165 | 4/1980 | Kirschstein | 250/560 |
| 4,208,578 | 6/1980 | McLoughlin et al. | 250/214 AG |
| 4,350,170 | 9/1982 | Baier | 131/84.1 |
| 4,413,637 | 11/1983 | Irving | 131/84.1 |
| 4,474,190 | 10/1984 | Brand | 131/84.1 |
| 4,535,789 | 8/1985 | Irving et al. | 131/84.2 |

FOREIGN PATENT DOCUMENTS

| | | |
|---|---|---|
| 0057992 | 8/1982 | European Pat. Off. . |
| 888478 | 1/1962 | United Kingdom . |

*Primary Examiner*—Richard J. Apley
*Assistant Examiner*—H. Macey
*Attorney, Agent, or Firm*—Cushman, Darby & Cushman

[57] ABSTRACT

The device disclosed comprises at least two optical detectors, each of which having two optical assemblies, diametrically opposed in relation to the rod exiting from a cigarette making machine, and a light-sensitive component consisting of an array of charge-coupled devices of the type used for scanning images. With each scan, the detectors emit signals reflecting the transverse dimensions of the rod which are first compared with a threshold signal reflecting the nominal diameter of the rod, and then utilized in conjunction with stepping motors to control devices which correct the transverse dimensions of the rod.

7 Claims, 6 Drawing Figures

DEVICE FOR VERIFICATION AND CORRECTION OF THE TRANSVERSE DIMENSIONS OF PRODUCTS IN THE FORM OF A ROD, IN PARTICULAR IN MACHINES FOR THE MANUFACTURE OF CIGARETTES AND THE LIKE

BACKGROUND of the INVENTION

The invention described herein relates to a device for verification and correction of the transverse dimensions of products in the form of a rod, in particular in machines for the manufacture of cigarettes and the like.

The substance of the following specification, which refers to a cigarette making machine, remains substantially valid likewise for a machine used in making cigarette filters.

The prior art embraces devices for verification of the transverse dimensins of such products, which are based on different operating principles. In British Pat. No. 888.478, a continuous rod turned out by a cigarette-making macine passes continuously endwise through a chamber supplied with gas (air) at constant pressure, which escapes by way of orifices through which the rod enters and leaves the chamber. Clearly, variation in the transverse dimensions of the rod causes variation in the area of the orifices via which air escapes, and as a result, of pressure inside the chamber; such pressure therefore gives an indication of the transverse dimensions of the length of rod occupying the chamber, at any given moment.

This pneumatic type of system does not offer a sufficient degree of precision however, as pressure levels measured within the chamber are influenced to a considerable extent by high porosity of the paper used in manufacture of the continuous cigarette rod, as well as by the speed at which the rod is conveyed.

The prior art further embraces devices such as that described in publication No. 0057992 for European Patent, wherein verification of the transverse dimensions of the cigarette rod is accomplished utilizing flexible feelers; one end of such a feeler is integral with a stationary support, whilst the remaining end is held in contact with the continuous rod. Means used to detect variation in tension of the feelers provide an output in the form of electrical signals, reflecting the circumferential dimensions of the rod, which can be utilized to implement such corrective measures as may be envisaged.

It will be clear enough that, in a device of this type, the sliding action of the feelers against the continuous rod may occasion damage to the rod itself, especially in ultra high speed cigarette making machines. What is more, the vibration of such feelers caused by sliding movement of the continuous rod, can give rise to errors in detection which in their turn are translated into errors in correction of the rod's circumference.

The object of the invention described herein it that of embodying a device for verification and correction of the transverse dimensions of cigarettes and similar products in the form of a continuous rod or in discrete lengths, which is able to eliminate all of the drawbacks connected with the prior art by adoption of a system that requires the use neither of pneumatic nor of mechanical means of detection.

SUMMARY of the INVENTION

The stated object is realized with the invention disclosed herein, which relates to a device for verification and correction of the transverse dimensions of products in the form of a rod, in particular, in machines for the manufacture of cigarettes and the like comprising a flat bed for formation of the continuous cigarette rod and provided, proceeding downstream in the direction of movement of the rod, with devices for channelling and folding a strip of paper around a filler to fashion the rod; a glueing device for application of an adhesive to at least one of the longitudinal edges of the strip; devices for correction of the transverse dimensions of the rod; a device for fastening the strip around the filler so as to form the continuous rod, wherein use is made of at least two optical detectors incorporating an array of light-sensitive charge-coupled devices, arranged in linear sequence downstream of the fastening device and able to generate signals, in response to the degree of light shed on the array, such as to reflect the transverse dimensions of the rod through two distinct directions set apart at a given angular distance; and of circuitry which processes the signals emitted by the detectors and which, in conjunction with at least one stepping motor, controls devices for correction of the transverse dimensions of the rod.

BRIEF DESCRIPTION of the DRAWINGS

The invention will now be described by way of example with reference to the accompanying drawings, in which.

DESCRIPTION of the PREFERRED EMBODIMENTS

Figure 1:
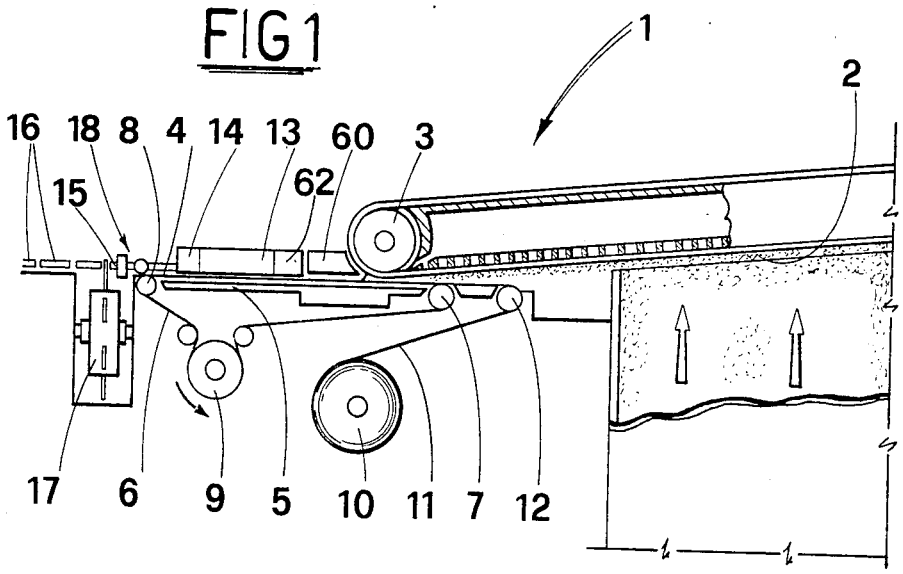
FIG. 1 is the schematic representation of a device according to the invention, located on the line along which a continuous cigarette rod is fed, in a cigarette making machine of which only those parts central to the description are illustrated.

With reference to FIG. 1, 1 denotes a cigarette making machine in its entirety. 2 denotes the bottom stretch of a vacuum conveyor looped around rolls 3 at either end (one only of which is visible in FIG. 1). 4 denotes the top stretch of a conveyor belt 6 which rides over a substantially flat bed 5; this conveyor belt is looped 6 around rolls 7 and 8 at either end and driven by a pinch roll 9 turning in counterclockwise direction.

10 denotes a coil from which a strip 11 of cigarette paper is wound out and diverted by a return roll 12 at a level above that of the stretch of belt denoted 4.

At the point where conveyor stretch 4 meets with conveyor stretch 2, the latter conveyor deposits a continuous filler of shredded tobacco directly onto the strip 11 of cigarette paper.

Utilizing methods known to a person skilled in the art, the conveyor stretch 4 rides over the bed 5 in a channel-and-fold device 60 comprising a groove that gradually brings the stretch of belt 4, hence the strip 11 of paper, into a substantially U-type formation around the tobacco filler, and thereafter into a closed loop so as to wrap the tobacco filler in a paper sheath of tubular shape.

A glueing device of conventional type, located at a point along the conveyor stretch 4 and denoted 62 in its entirety, applies a smear of adhesive to the inside face of one of the two longitudinal edges of the strip 11 of paper, by way of a nozzle not illustrated in the drawings.

Positioned along the conveyor stretch 4 downstream of the glueing device 62 are a device 13 (to be described in more detail below) which establishes and/or corrects the transverse dimensions of the rod as it materializes gradually due to the strip 11 of paper ensheathing the tobacco filler, and thereafter, a fastening device 14 which dries out the adhesive by way of electric heating elements, thereby locking the strip 11 of paper over the tobacco filler and forming the so-called continuous cigarette rod; the rod, denoted 15 in FIG. 1, is divided into single cigarettes 16 by way of a rotary cutter 17.

Located between the fastening device 14 and the rotary cutter 17, one has a device for verification of the transverse dimensions of the rod 15; the assembly of parts making up the device is denoted 18.

Figure 2:
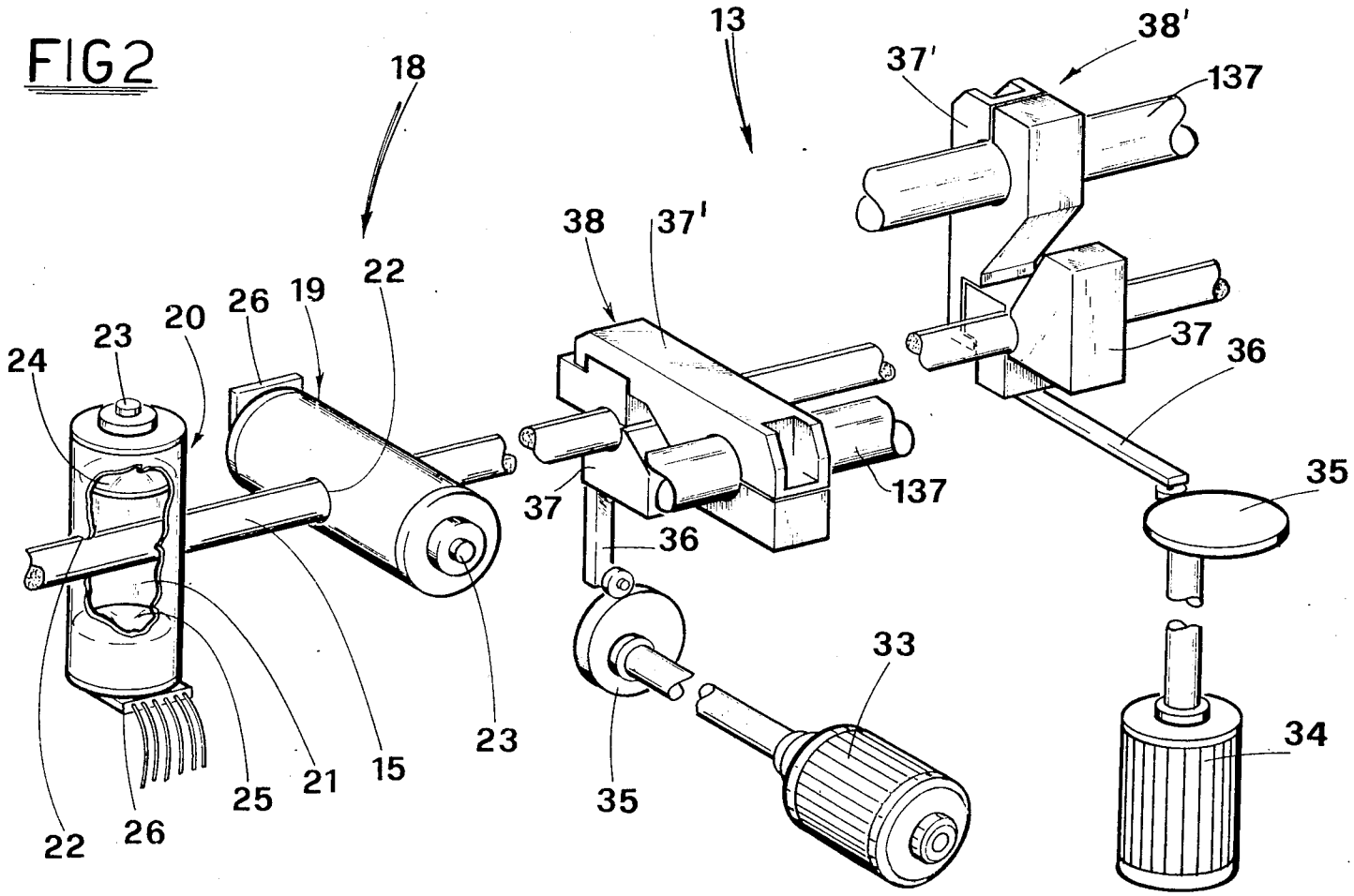
FIG. 2 is the schematic representation of a device according to the invention, seen in larger scale and limited to its more important working parts.

With reference to FIGS. 1 & 2, the device 18 comprises two components 19 and 20 for detection of the diameter of the rod 15, positioned upstream and downstream, respectively, along the path of movement of the rod. The first such detector 19 verifies the diameter of the rod 15 in a vertical direction, and the second 20 verifies the diameter of the rod 15 in a horizontal direction; the detectors are substantially identical, as also are the respective electrical circuits interlocked to them. This being the case, the following description refers generally to one such detector, and corresponding parts in the two detectors are denoted by the same reference number.

Each one of the two detectors 19 and 20 comprises a hollow body 21 substantially cylindrical in shape, mounted fixedly to the frame of the cigarette making machine, and provided with radial holes 22 allowing for passage of the cigarette rod 15. A light source 23 is fitted to one end of each hollow body 21 consisting, for example, of an infrared light emitting diode (LED) the beam of which is directed toward the far end of the self-same hollow body.

Each hollow body 21 accommodates two lenses 24 and 25 located in diametrical opposition one to the other, relative to the path of the continuous rod 15. The lens denoted 24 is schematically representative of an optical assembly deflecting rays emitted from the light source 23 along lines parallel to the axis of the hollow body 21, whereas the lens denoted 25 is schematically representative of an optical assembly focusing the light onto a light-sensitive element or sensor 26 offered to the end of the hollow body 21 opposite that at which the light source 23 is located, and consisting of number of image scanning sensors forming part of a charge coupled device (CCD) array of conventional type. Such an array is in effect a device with light sensitive transducers disposed in a linear arrangement and capable of generating pulses reflecting the degree to which light is shed on them. At every scan, each of the light-sensitive elements making up the CCD array produces an output signal of amplitude proportional to the intensity of light it receives.

Figure 3:
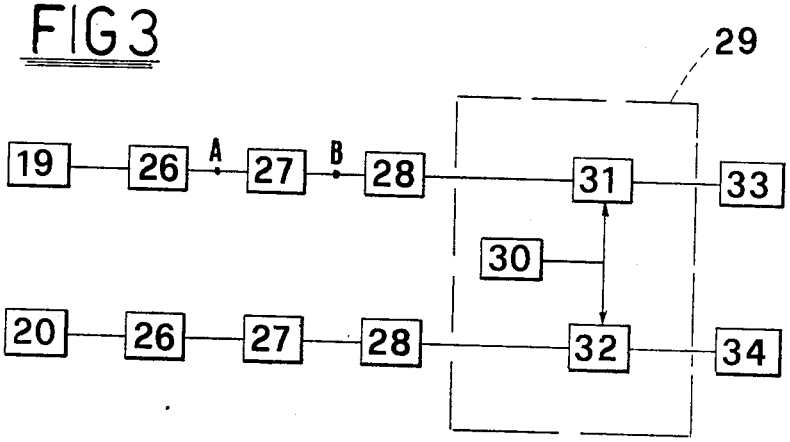
FIG. 3 is the block diagram of a possible electrical circuit forming part of the device described herein, serving for control of the motors which operate the devices for correction of the transverse dimensions of the rod, and are governed by the device to which the invention relates.

Referring now to FIG. 3, from the signal A produced at the output of the block denoting the light sensitive element 26, it is possible to discern two lateral bands consisting of a train of pulses, the amplitude of each of which is determined by light projected from the source 23 and falling on the CCD array 26, and a central section, consisting of pulses of lesser amplitude and coinciding with the dark zone projected onto the array by the cigarette rod 15. This output signal A from the CCDs 26 is inverted and then measured against a given threshold signal by a comparator 27; this in turn emits an output signal B consisting of a train of rectangular pulses, which mirrors the aforementioned central section and discards the lateral bands. The number of such rectangular pulses, monitored by a counter 28, indicates the width of the dark zone, and by definition, the diameter $\phi'$ exhibited by the continuous cigarette rod as it passes through the two detectors 19 and 20.

29 denotes a block of circuits into which the output lines from the CCD arrays 26 of the detectors 19 and 20 are both wired, which processes the aforementioned signals as follows.

In the block of circuits 29 shown in FIG. 3, a pulse generator 30 provides an output signal which is a function of the nominal diameter $\phi$ of the cigarette rod currently in production. This signal is fed into one of the inputs of two comparators 31 and 32 each of which has two inputs; the remaining input of the two comparators 31 an 32 is in reciept of the output signal from the counter 28 connected to each of the respective detectors 19 and 20.

Each comparator 31 and 32 emits an output signal, based on a comparison of the input signals, that can be used for operation of a respective stepping motor 33 or 34 to produce the following effects:

(a) clockwise rotation of the stepping motor shaft in the event that $\phi' > \phi$;

(b) no rotation whatever, where $\phi' = \phi$;

(c) anticlockwise rotation of the stepping motor shaft in the event that $\phi' < \phi$.

With reference to FIG. 2, it will be observed that the device 13 which establishes and/or corrects the transverse dimensions of the rod 15 comprises two bushes 38 and 38', through which the rod 15 formed by the machine is made to pass. Such bushes are disposed such that one follows the other, and consist of two separable breasted halves; in the bush denoted 38, the two halves breast one with the other through a horizontal plane, whereas in the bush denoted 38' the two halves breast through a vertical plane. The fixed half 37 of each of each bush 38 and 38' is supported by the body of the device 13, whilst the remaining half 37' is movable and pivoted about a pin 137 lying parallel to the axis of the cigarette rod 15 and embodied integral with the main body of device 13.

36 denotes a lath associated with each of the movable halves 37', and guided in slidable fashion within the body of the device 13. The remaining end of each such lath 36 engages the profile of a relative cam 35, the cams in their turn being keyed to the shafts of respective stepping motors 33 and 34.

It will be clear that rotation of the shaft of either motor 33 and 34 in one direction or the other will rotate the cams 35, occasioning slight angular movement which separates or draws together the two halves of the bushes 38 and 38' and producing a correspondingly greater or lesser cross-section of the passage with is afforded to the cigarette rod 15, hence an increase or decrease in cross-section of the rod itself, according to the correction implemented in response to the diameter of the rod 15 revealed by the detectors 19 and 20 on its exit from the machine.

In the above instance, therefore, one produces a correction on the basis of a linear measurement of 'two diameters' of the rod 15, which may be referred to as horizontal and vertical, as it exits from the machine.

Figure 4:
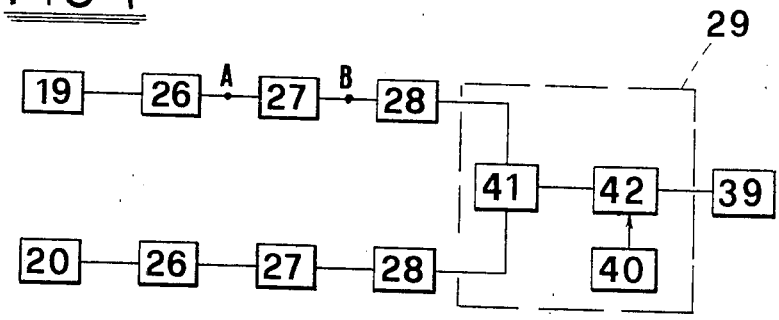
FIG. 4 shows the block diagram of another possible electrical circuit of the type illustrated in FIG. 2.

In the arrangement of FIG. 4, correction of the cross-section of a rod 15 exiting from the machine is obtained using one stepping motor 39 only and made on the basis of a signal from a pulse generator 40, that is a function of the nominal cross-sectional area S of the rod 15. In this instance, output signals from the counters 28 are fed into a processor 41 (packaged chip, for example) capable of computing on the input signals it receives and, according to the diameter verified during passage of the rod 15 through each of the detectors 19 and 20, of producing an output signal that is a function of the effective cross-section S' of the rod 15 calculated on the basis of signals emitted by the counters 28. The output signals from block 40 and block 41 are relayed to a comparator 42, having two inputs, which produces an output signal for operation of the stepping motor 39 in order to produce the following effects:

(a) clockwise rotation of the stepping motor shaft, in the event that $S'>S$;

(b) no rotation whatever, where $S'=S$;

(c) counterclockwise rotation of the stepping motor shaft, in the event that $S'<S$.

Exploiting the circuit of FIG. 4, the device 13 for correction of the transverse dimensions of the rod 15 may comprise a single bush 43 (as in FIG. 5) or 44 (FIG. 6) which will produce the necessary corrections in the following manner.

Figure 5:
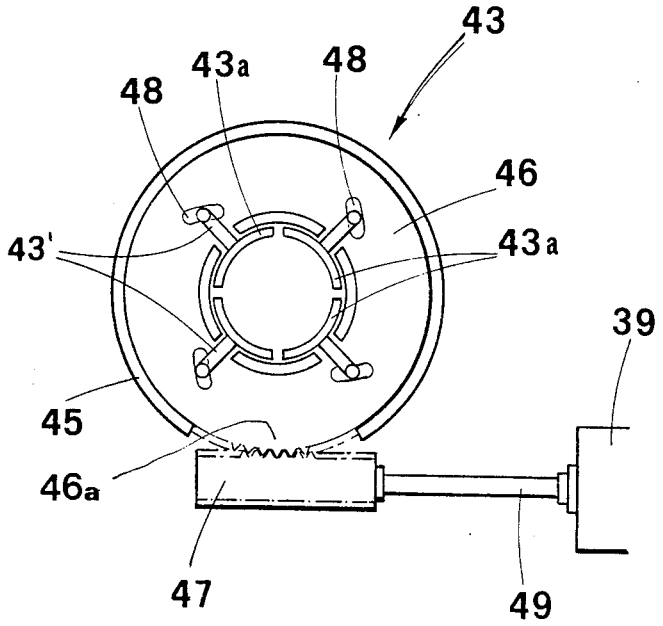
FIGS. 5 and 6 are schematics, viewing from the front, of two possible embodiments of the means for correction of the transverse dimensions of the rod, which might be utilized in place of the means illustrated in FIG. 2 in a device according to the invention.

As embodied in FIG. 5, the bush 43 is composed of four segments 43*a* opposed in pairs, each one of which provided with a push-rod 43' that is slidably mounted in a seat formed in the internal wall of a dished flange 45 fixed to the body of the device 13. The flange 45 also carries a wheel 46 provided with a sector 46*a* having helical teeth that mesh with a worm 47 keyed to the shaft 49 of the stepping motor 39. One side of such a wheel 46 exhibits a set of four slots 48 angled in relation to the path of movement described by the push-rods 43' which, by virtue of their outer ends being slidable within the slots 48, constitute means of engagement.

It will be clear that rotation of the wheel 46 produced by clockwise or counterclockwise rotation of the motor shaft 49 occasions sliding movement of the push-rods 43' in their seats through a radial path, in relation to the bush 43, resulting in a reciprocal drawing together or separation of the segments 43*a*, thereby varying the cross-sectional area allowed for passage of the rod 15 during formation.

Figure 6:
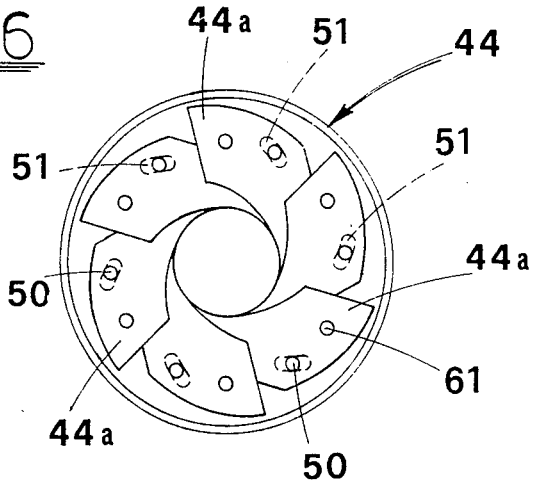

As embodied in FIG. 6, the bush 44 may be of a shutter diaphragm type having a variable aperture and comprising a set of sectors 44*a* hinged about pivots 61 to a first ring integral with the main body of the device 13. Each such sector 44*a* exhibits a projection in the form of a pin 50 designed to locate in a corresponding slot 51 offered by a second ring (which is not visible) breasted with the first ring and mounted rotatably to an annular flange likewise integral with the body of the device 13. This second ring may also have a peripheral sector with helical teeth, that coincides with an opening in the annular flange so as to mesh with a worm which, as in the case of FIG. 5, may be keyed to the shaft of the stepping motor 39.

Likewise in this instance, the direction of rotation of the motor shaft 49 will produce rotation of the sectors 44*a* either toward or away from the center of the bush 44, varying the cross-sectional area afforded for passage of the cigarette rod 15 during its formation.

What is claimed:

1. An apparatus for verification and correction of the transverse dimensions of products in the form of a rod, in particular, in machines for the manufacture of cigarettes and the like including a flat bed for formation of the continuous cigarette rod and provided, proceeding downstream in the direction of movement of the rod, said apparatus comprising: means for channelling and folding a strip of paper around a filler to fashion the rod; glueing means for applying an adhesive to at least one of the longitudinal edges of the strip; means for correction of the transverse dimensions of the rod; and means for fastening the strip around the filler so as to form the continuous rod; at least two optical detectors incorporating an array of light-sensitive charge-coupled devices, arranged in linear sequence downstream of the fastening means and able to generate signals, in response to the degree of light shed on the array, such as to reflect the transverse dimensions of a rod through two distinct directions set apart at a given angular distance; and circuitry which processes the signals emitted by the detectors and which, in conjunction with at least one stepping motor, controls the means for correction of the transverse dimensions of the rod.

2. Apparatus as in claim 1 wherein the means for correction of the transverse dimensions of the rod is of the type comprising a bush formed from two breasted halves between which the rod passes during the course of its formation, one of which halves is fixed to the flat bed, and the other movable in relation to the first; wherein there are at least two such bushes, one downstream of the other, with their respective halves breasting through the horizontal plane and the vertical plane respectively; and wherein the movable half of each bush is pivoted about an axis parallel with the axis of the rod and adjustable in relation to the fixed half by way of a cam keyed to the shaft of a respective stepping motor.

3. Apparatus as in claim 1 wherein the means for correction of the transverse dimensions of the rod is of the type comprising a bush through which the rod passes during the course of its formation, formed of four segments opposed in pairs and movable in linear fashion back and forth through a radial path in relation to the body of the bush through operation of a flange which is rotatably mounted to a body forming part of said correction means and linked kinematically to the shaft of a stepping motor; wherein the flange is provided with a set of slots which are angled in relation to the radial path of movement of the segments, and in which means of engagement connected with the segments are slidable; and wherein the stepping motor is connected to both optical detectors by way of the circuitry.

4. Apparatus as in claim 1 wherein the means for correction of the transverse dimensions of the rod is of the type comprising a bush, through which the rod passes in the course of its formation, which is embodied as a shutter diaphragm with a variable aperture having a set of sectors, spaced apart at equal angular distance, hinged with a first ring integral with a body forming part of said correction means, and exhibiting a projection for engaging in a relative slot extending through a path other than concentric with the bush and located in a second ring breasted with the first; and wherein the second ring is mounted to an annular flange integral with said body and linked kinematically with the shaft of a stepping motor which in its turn is interlocked to both of the optical detectors by way of the circuitry.

5. Apparatus as in claim 1 wherein the circuitry comprises a pulse generator emitting a signal indicative of the nominal diameter of the rod currently in production, and a comparator relative to each detector, the input of which is in receipt of the outputs both of the pulse generator and of the detector, and the output of which provides a signal controlling operation of a relative stepping motor.

6. Apparatus as in claim 1, wherein the circuitry comprises a pulse generator emitting a signal indicative of the nominal cross-sectional area of the rod currently in production; a circuit module that processes the signals emitted by the optical detectors and produces a signal indicative of the cross-sectional area of the rod computed on the basis of such signals; and a comparator the input of which is in receipt of the output of the pulse generator and of the processor circuit module, and the output of which provides a signal controlling operation of the stepping motor.

7. Apparatus as in claim 1 wherein each of the detectors comprises optical assemblies located in diametrical opposition either side of the rod, wherein one assembly deflects light rays emitted from the light source through lines parallel with each other, and the opposite assembly focuses such rays on the sensors.

* * * * *